US008534019B2

(12) United States Patent
Rogers et al.

(10) Patent No.: US 8,534,019 B2
(45) Date of Patent: Sep. 17, 2013

(54) GLASS BLOCK WITH LOW-E CENTER LITE

(75) Inventors: Tracy G. Rogers, Dover, OH (US); Todd W. Haney, Cambridge, OH (US); Gerhard Reichert, New Philadelphia, OH (US)

(73) Assignee: Quanex IG Systems, Inc., Cambridge, OH (US)

( * ) Notice: Subject to any disclaimer, the term of this patent is extended or adjusted under 35 U.S.C. 154(b) by 0 days.

(21) Appl. No.: 13/054,886

(22) PCT Filed: Jul. 22, 2009 (Under 37 CFR 1.47)

(86) PCT No.: PCT/US2009/004250

§ 371 (c)(1), (2), (4) Date: Jun. 20, 2011

(87) PCT Pub. No.: WO2010/011307

PCT Pub. Date: Jan. 28, 2010

(65) Prior Publication Data

US 2012/0176805 A1 Jul. 12, 2012

Related U.S. Application Data

(60) Provisional application No. 61/082,724, filed on Jul. 22, 2008.

(51) Int. Cl.
*E04B 5/46* (2006.01)
*E04C 1/42* (2006.01)

(52) U.S. Cl.
USPC ..... 52/306

(58) Field of Classification Search
USPC ..... 52/306, 307, 308, 200
See application file for complete search history.

(56) References Cited

U.S. PATENT DOCUMENTS

| | | | | | |
|---|---|---|---|---|---|
| 2,118,643 | A | * | 5/1938 | Fox | 52/307 |
| 2,167,764 | A | * | 8/1939 | Lytle | 52/307 |
| 2,194,756 | A | * | 3/1940 | Kell | 52/306 |
| 2,221,649 | A | * | 11/1940 | Mulford | 52/307 |
| 2,532,478 | A | * | 12/1950 | Bridges | 52/306 |
| 3,694,013 | A | * | 9/1972 | Heitner | 52/200 |
| 4,058,943 | A | * | 11/1977 | Sturgill | 52/223.7 |
| 4,831,799 | A | | 5/1989 | Glover | |
| 4,959,937 | A | * | 10/1990 | Mayer | 52/308 |
| 4,986,048 | A | * | 1/1991 | McMarlin | 52/306 |
| 5,033,245 | A | * | 7/1991 | Kline | 52/306 |

(Continued)

OTHER PUBLICATIONS

1997, Edgetech's Super U offers triple-pane solution.

(Continued)

*Primary Examiner* — Mark Wendell
*Assistant Examiner* — Keith Minter
(74) *Attorney, Agent, or Firm* — Zollinger & Burleson Ltd.

(57) ABSTRACT

A glass block assembly (2) includes first (4) and second (6) glass block halves. A spacer (8) is disposed between the glass block halves to thermally isolate the first glass block half from the second glass block half. A sealant extends from the outer surface of the first glass block half over the spacer to the outer surface of the second glass block half to hermetically seal the internal chamber of the assembly. The spacer has a pair of legs (24) extending laterally outwardly from the body to define shoulders that engage the inner surfaces of the first and second halves. The legs of the spacer define a slot (25). An interior lite (10) is carried by the spacer in the interior chamber.

22 Claims, 6 Drawing Sheets

(56) References Cited

U.S. PATENT DOCUMENTS

| | | | | |
|---|---|---|---|---|
| 5,160,566 | A * | 11/1992 | Ashby et al. | 156/252 |
| 5,191,718 | A * | 3/1993 | Fox | 33/526 |
| 5,414,968 | A * | 5/1995 | Willner | 52/306 |
| 5,485,702 | A * | 1/1996 | Sholton | 52/308 |
| 6,266,940 | B1 * | 7/2001 | Reichert | 52/786.13 |
| 6,553,733 | B1 * | 4/2003 | Hock et al. | 52/306 |
| 6,640,510 | B2 * | 11/2003 | Kane | 52/204.59 |
| 7,114,299 | B2 * | 10/2006 | Ringness | 52/204.1 |
| 7,266,930 | B1 * | 9/2007 | Fisher | 52/306 |
| 7,555,872 | B1 * | 7/2009 | Beach | 52/745.1 |
| 7,587,870 | B2 * | 9/2009 | Voegele et al. | 52/308 |
| 7,877,947 | B2 * | 2/2011 | Borressen et al. | 52/306 |
| 8,176,693 | B2 * | 5/2012 | Abbott et al. | 52/173.3 |
| 8,240,110 | B2 * | 8/2012 | Griffiths | 52/787.11 |
| 2001/0015037 | A1 * | 8/2001 | Thompson, Jr. | 52/172 |
| 2003/0074859 | A1 | 4/2003 | Reichert et al. | |
| 2004/0076815 | A1 | 4/2004 | Reichert | |
| 2007/0011960 | A1 * | 1/2007 | Richardson | 52/200 |
| 2007/0130859 | A1 * | 6/2007 | Borressen et al. | 52/306 |
| 2008/0053023 | A1 * | 3/2008 | Stenvall | 52/474 |
| 2008/0134594 | A1 * | 6/2008 | Ness | 52/200 |
| 2008/0163579 | A1 * | 7/2008 | Kreyenborg et al. | 52/474 |
| 2008/0190051 | A1 * | 8/2008 | Nugue | 52/204.5 |
| 2009/0007510 | A1 * | 1/2009 | McCoy et al. | 52/306 |
| 2010/0139191 | A1 * | 6/2010 | Atherton | 52/306 |
| 2012/0167506 | A1 * | 7/2012 | Piroli | 52/306 |

OTHER PUBLICATIONS

Earlier than Aug. 9, 2000; Edgetech Advertising—Cushion Edge.

* cited by examiner

GLASS BLOCK WITH LOW-E CENTER LITE

CROSS REFERENCE TO RELATED APPLICATIONS

This application is a U.S. National Stage Patent Application filed under 35 U.S.C. §371 claiming priority to PCT/US2009/004250 having an international filing date of Jul. 22, 2009. This application claims the benefit of US Provisional Patent Application 61/082,724 filed Jul. 22, 2008.

BACKGROUND OF THE INVENTION

1. Technical Field

The application generally relates to multiple glazing sheet glazing units and, more particularly, to glass blocks. Specifically, the application relates to a glass block having an internal center lite that may be a low-e center lite and/or an internal insulating glazing unit incorporating clear and/or low-e glazing.

2. Background Information

Glass blocks have been used for years in numerous applications. Traditional glass blocks are available in various sizes and thicknesses. All of these sizes and thicknesses have front and rear glass lites spaced apart by a glass sidewall. Glass blocks are formed by heating two block halves to a temperature hot enough to weld or fuse the block halves together when the sidewalls are abutted against one another.

Recent energy conservation requirements encourage the use of a low emissivity coating (low-e coating) on window units to reduce radiant heat transfer. Glass block manufacturers thus desire to add a low-e coating to at least one of the glass block halves or to add an internal low-e coated lite to the interior of the glass block. The step of fusing the glass block halves together will destroy a low-e coating added to a glass block half prior to the fusing step.

SUMMARY OF THE INVENTION

The invention generally provides a glass block having an internal low-e coated lite. The internal chamber of the glass block is sealed against moisture vapor.

Another configuration of the invention provides a spacer for a glass block that separates the glass block halves and supports a center lite. The center lite may be low-e coated. The internal chamber of the glass block may be sealed to prevent moisture vapor from migrating into the glass block.

Another configuration of the invention provides a method for sealing the sidewall of the glass block after the interior lite is assembled between the glass block halves.

Another configuration of the invention provides a glass block having an interior low-e coated lite wherein the internal chamber of the glass block is sealed against moisture vapor migration. The glass block halves are separated by a thermal break. The sidewall of the glass block is configured to have a uniform appearance when viewed through the front or rear lites of the glass block.

Another configuration of the invention provides a glass block having an interior insulating glazing unit sealed within the glass block assembly wherein the entire glass block/insulating glazing unit are sealed against moisture vapor migration. Additionally, said unit configurations are sealed against insulating gas egress (e.g., argon, krypton, etc.) from the glass block system.

A further configuration of the invention generally provides a glass block spacer adapted to hold a pair of interior lites.

In one configuration, the invention provides a glass block assembly having first and second glass block halves; each glass block half having a sidewall and an outer face; the sidewalls having inner surfaces and outer surfaces; the glass block halves facing each other to define an internal chamber; a spacer disposed between the glass block halves to thermally isolate the first glass block half from the second glass block half; the spacer including a body disposed directly between the sidewalls of the glass block halves; a sealant disposed between the spacer and the glass block to hermetically seal the internal chamber; the spacer having a pair of legs extending laterally outwardly from the body to define shoulders that engage the inner surfaces of the first and second glass block halves; the legs of the spacer defining a slot; and an interior lite disposed in the interior chamber; the interior lite being carried in the slot.

Another configuration of the invention provides a glass block assembly having first and second glass block halves; each glass block half having a sidewall and an outer face; the sidewalls having inner surfaces and outer surfaces; the glass block halves facing each other to define an internal chamber; a spacer disposed between the glass block halves to thermally isolate the first glass block half from the second glass block half; the spacer including a body disposed directly between the sidewalls of the glass block halves; a sealant disposed between the spacer and the glass block to hermetically seal the internal chamber; the spacer having a pair of legs extending laterally outwardly from the body to define shoulders that engage the inner surfaces of the first and second glass block halves; each of the legs of the spacer having an outer surface; and a first interior lite disposed in the interior chamber; the first interior lite being adhesively connected to the outer surface of one leg.

The invention also provides a method of forming a glass block having a low-e interior lite wherein the method includes the steps of wrapping the outer perimeter of a low-e interior lite with a spacer; positioning the spacer on a first glass block half; connecting a second glass block half to the spacer to sandwich the spacer between the glass block halves and to position the low-e interior lite in an internal chamber; and applying a sealant to the spacer and the glass block halves to hermetically seal the internal chamber.

BRIEF DESCRIPTION OF THE DRAWINGS

FIG. 5 is a view similar to. FIG. 1 showing the use of a sealant tape to seal the spacer.

Similar numbers refer to similar parts throughout the application.

DETAILED DESCRIPTION OF THE INVENTION

Figure 1:
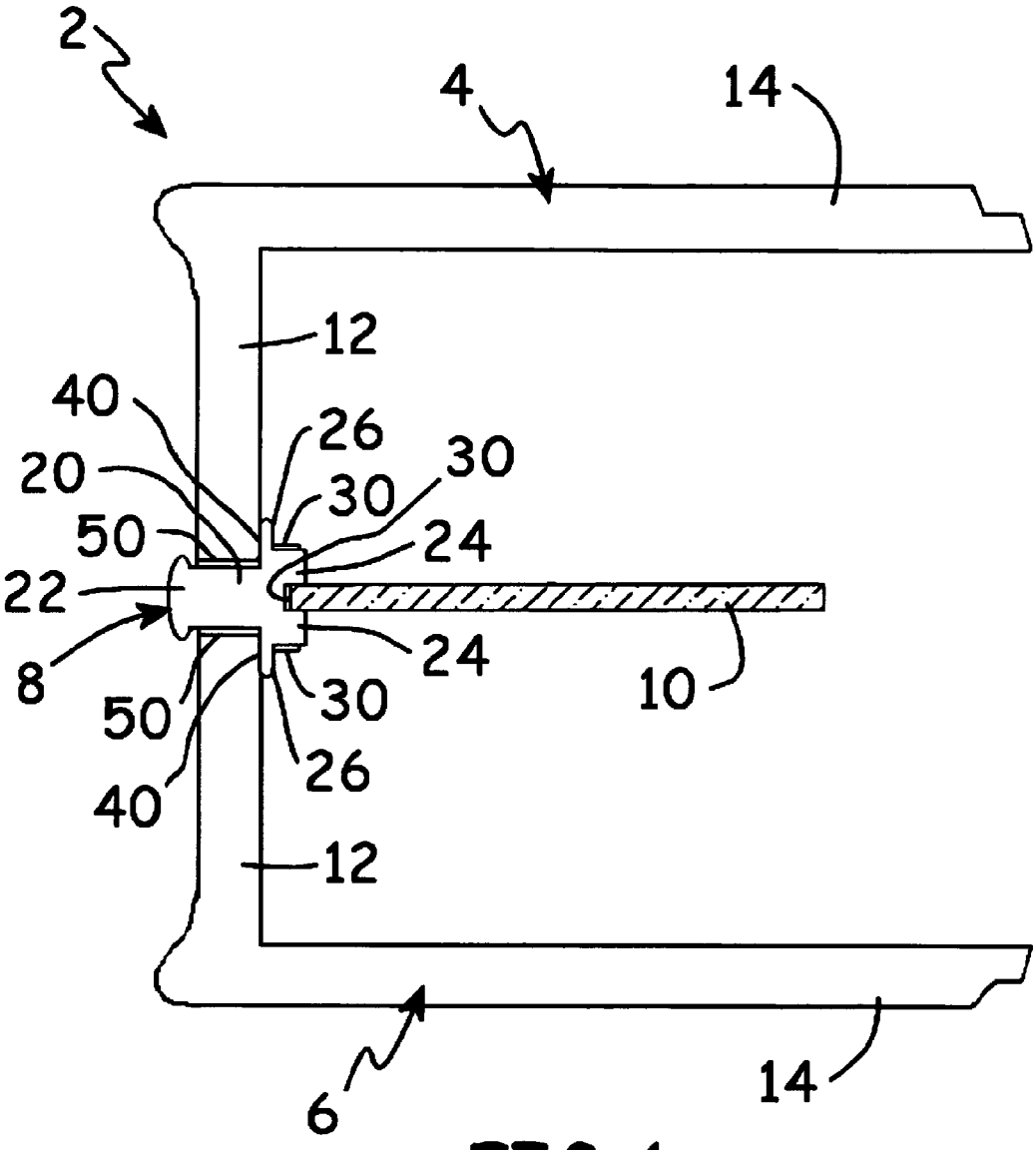
FIG. 1 is a section view of the top half of a glass block showing a spacer holding a single interior lite.

An exemplary glass block having at least one interior lite is indicated generally by the numeral 2 in the accompanying drawings. Glass block 2 includes first 4 and second 6 glass block halves, a spacer 8, and an interior lite 10. Interior lite 10 may be coated with a low-e coating. Interior lite 10 may be glass. Glass block 2 also includes a seal that hermetically seals the inner chamber of glass block 2.

Each glass block half 4 and 6 includes a sidewall 12 disposed substantially perpendicular to the outer face 14 of half 4 and 6.

Figure 2:
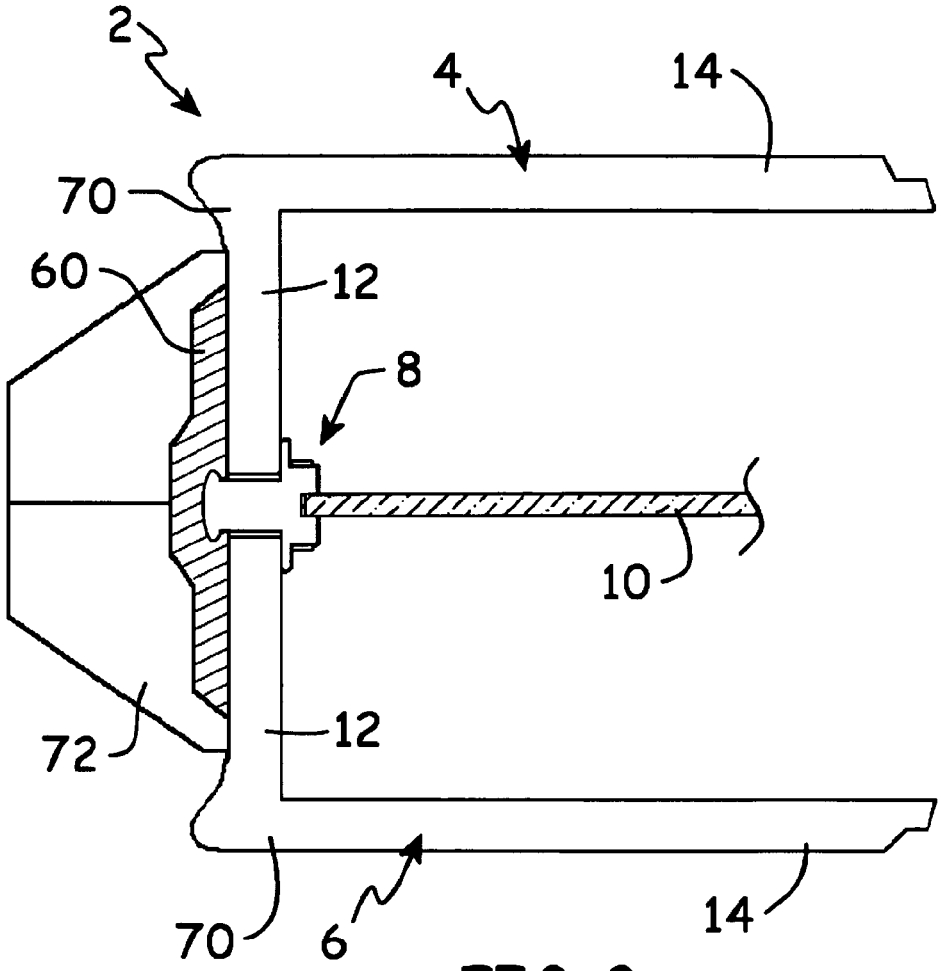
FIG. 2 is a view similar to FIG. 1 showing an extrusion die that may be used to add a layer of sealant to the outer surface of the sidewall over the top of the spacer.
Figure 3:
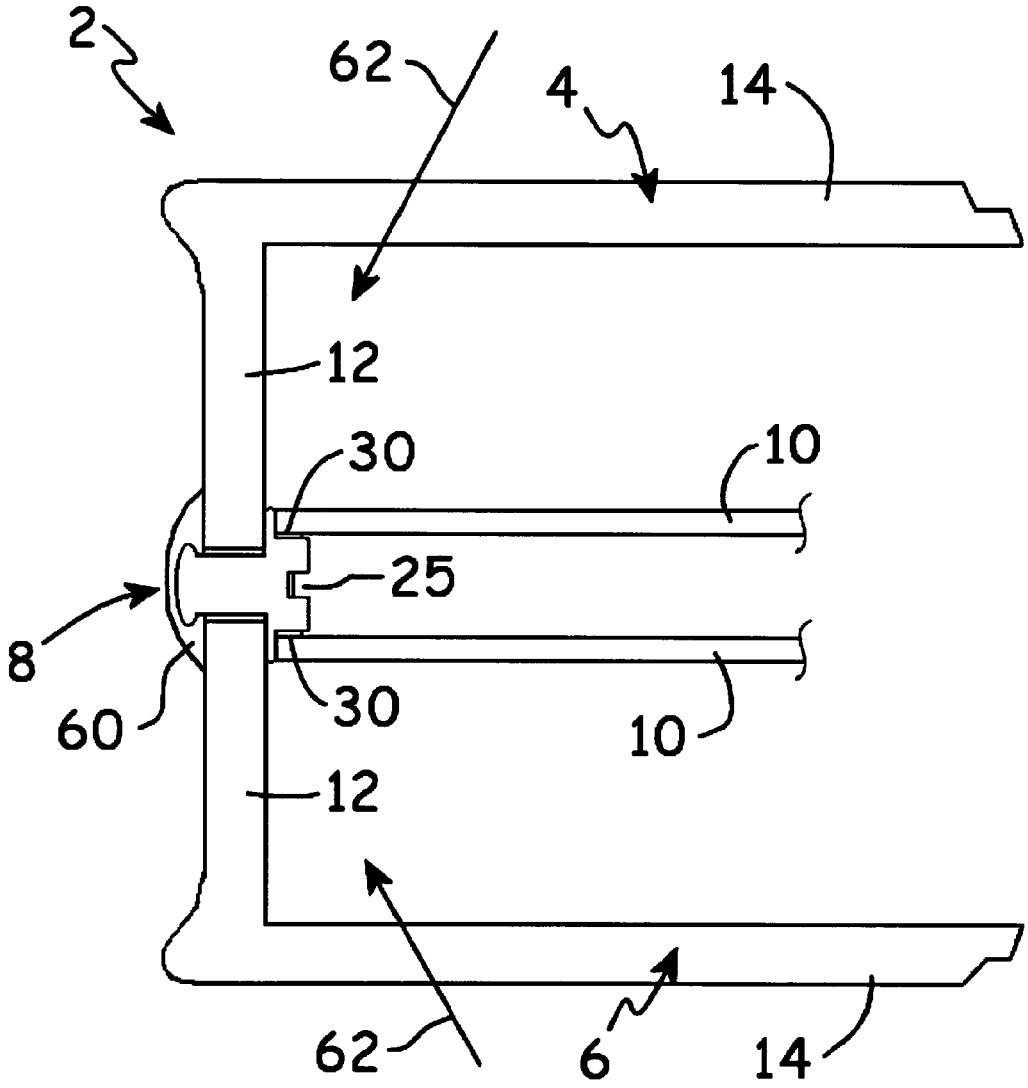
FIG. 3 is a view similar to FIG. 1 showing a pair of interior lites supported by the spacer.
Figure 4:
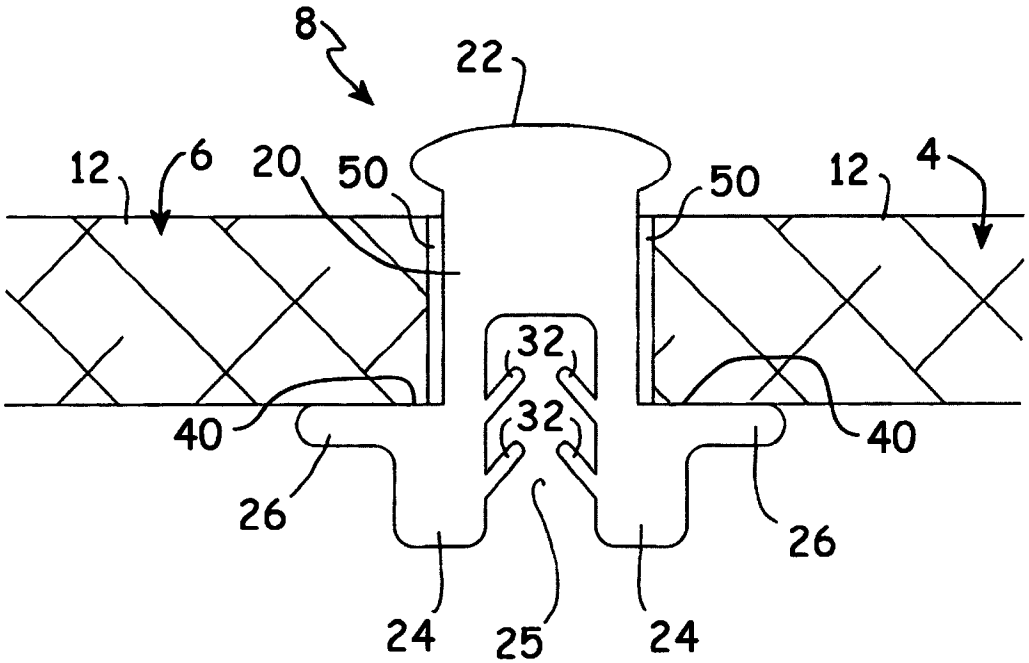
FIG. 4 is an enlarged view of an exemplary spacer.
Figure 5:
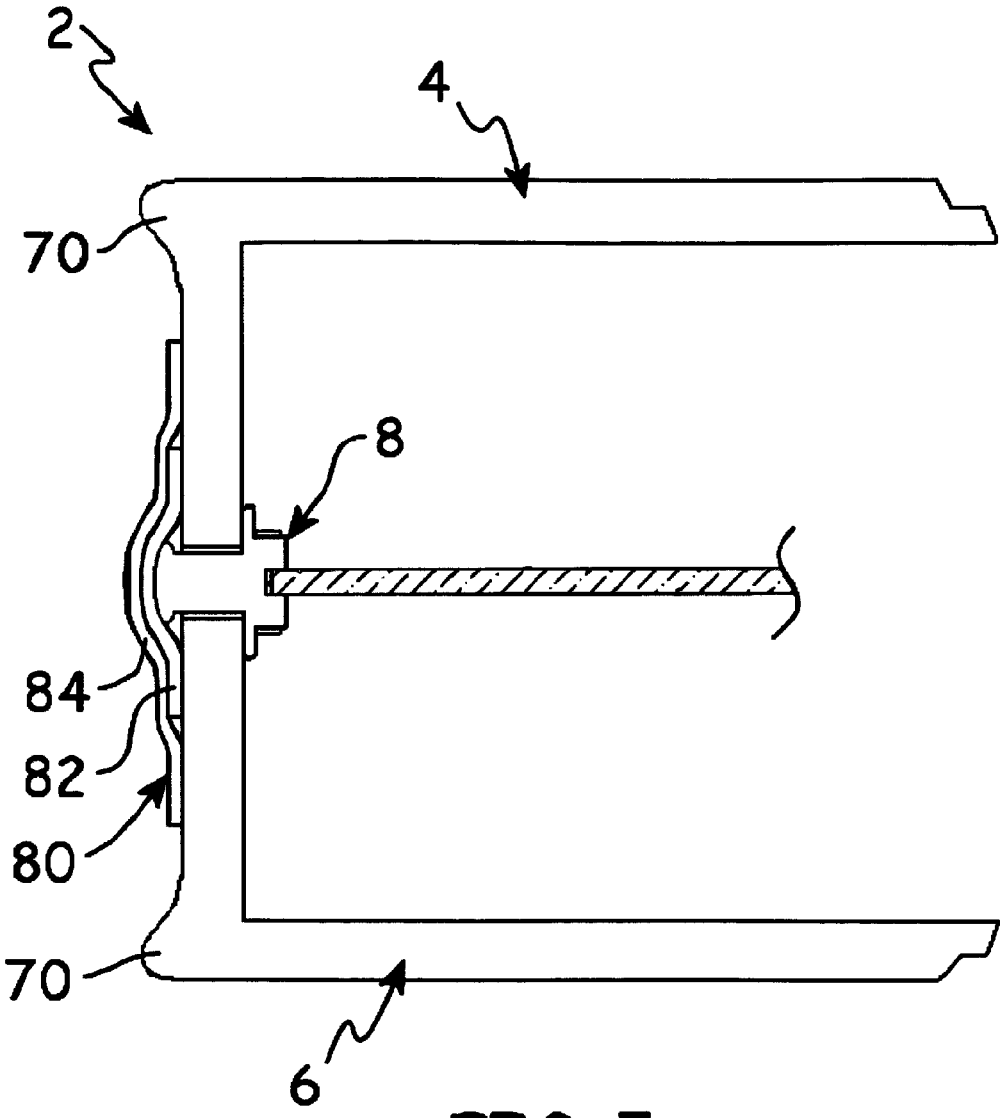
Figure 6:
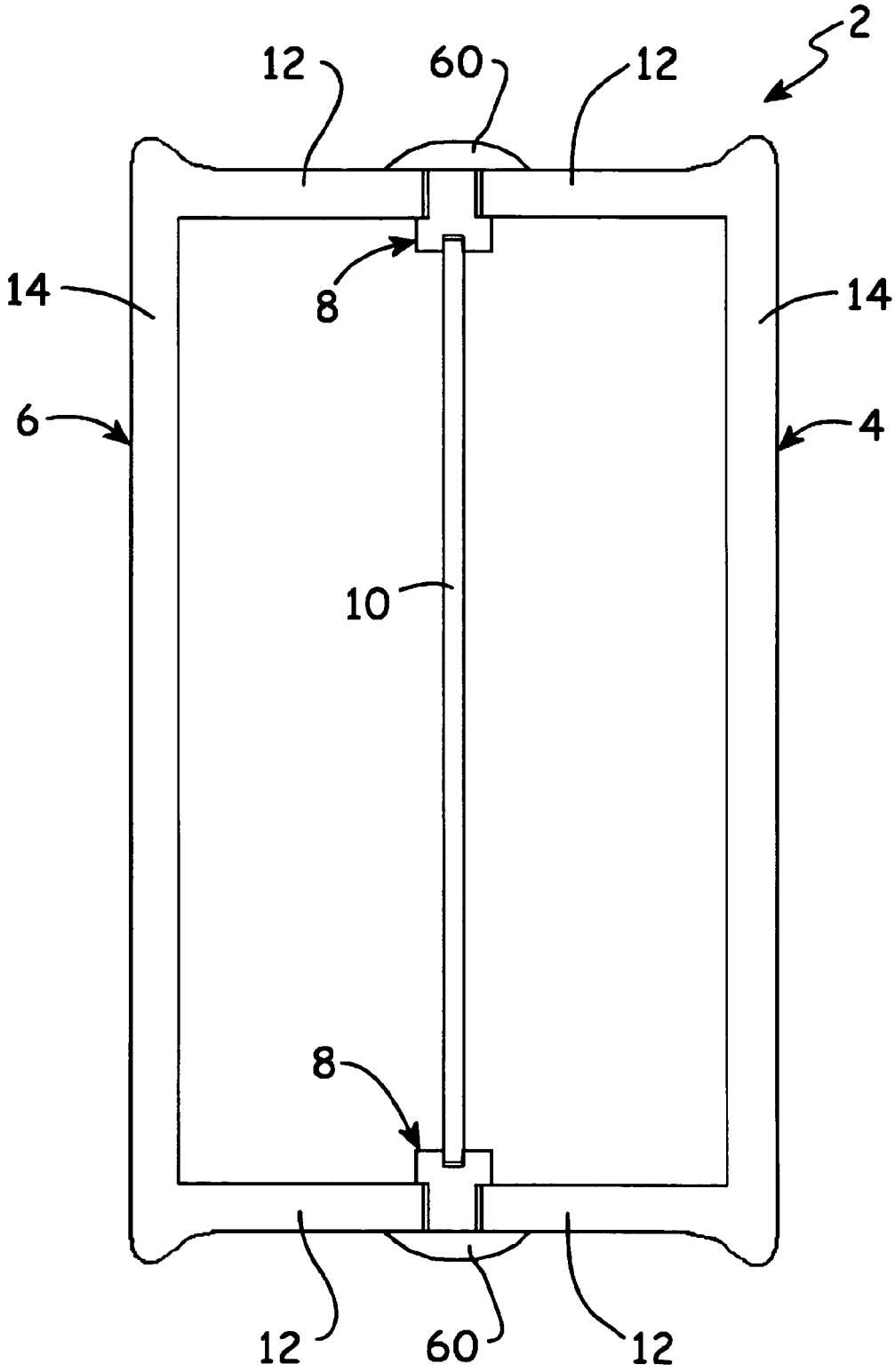
FIG. 6 is a section view taken through a glass block with a center lite held by a spacer.

Two exemplary configurations of spacer 8 are depicted. FIGS. 1-3 depict a first configuration and FIG. 4 depicts a second configuration. Each spacer 8 may be fabricated from a silicone material or any of a variety of other flexible spacer materials known in the art. For example, spacer 8 may be a silicone, a rubber, an EPDM, or a plastic. The material may be foamed. Spacer 8 carries a desiccant to adsorb moisture in the chamber of glass block 2 to prevent condensation or fogging inside glass block 2. Spacer 8 may be 50 percent (by weight) desiccant.

Each spacer configuration includes a body 20 disposed directly between the ends of sidewalls 12 and either or both of a head 22 disposed outwardly of the sidewalls 12 and at least one leg 24 extending into the internal chamber of glass block 2. In the exemplary configuration, spacer 8 includes two spaced legs 24 that define a slot 25 that receives the outer circumferential edge of lite 10. Each spacer configuration optionally may be provided with a pair of arms 26 that extend parallel to the inner surface of sidewalls 12. The first configuration of spacer 8 positions slot 25 inwardly of the inner surfaces of sidewalls 12 such that no portion of slot 25 is disposed directly between the ends of sidewalls 12. The end of slot 25 may be spaced inwardly from the inner surfaces of sidewall 12 a distance greater than the thickness of lite 10. The second configuration of spacer 8 extends slot 25 directly between the ends of sidewalls 12.

In the first configuration of spacer 8, lite 10 may be secured with an optional adhesive 30 disposed in slot 25. In the second configuration of spacer 8, optional fingers 32 extend into slot 25 to frictionally hold lite 10. Fingers 32 are angled toward the end of slot 25 to provide a holding force to lite 10. Adhesive 30 and fingers 32 may be used together or alone in both of the configurations of spacer 8. Adhesive 30 and fingers 32 may be removed.

In both of the exemplary configurations, legs 24 define a shoulder 40 that rests against the inner surface of sidewalls 12. Shoulders 40 position spacer 8 with respect to sidewalls 12 during the assembly of unit 2. In another configuration, legs 24 are the same width as body 20.

When arms 26 are used, each arm 26 projects away from legs 24 along the inner surface of sidewall 12. Each arm 26 is not as tall as legs 24 so that a corner is defined that may be used to seat the outer circumferential edge of lite 10 as shown in FIG. 3. Adhesive 30 may be used hold lite 10 against the outer surface of leg 24 or against the inwardly-facing surface of arms 26. When lite 10 is used on the outside of leg 24, adhesive 30 disposed in slot 25 is not necessary. This configuration may be used to form an assembly 2 having one, two, or three lites 10.

Head 22 is optional. In the configurations having head 22, head 22 is wider than body 20 so that portions of head 22 extend over the outer surfaces of sidewalls 12 to define notches. These notches may receive and hold sealant. Body 20 may protrude outwardly beyond the outer surface of sidewalls 12 to position head 22 spaced outwardly from the outer surfaces of sidewalls 12.

Spacer 8 may be held between glass block halves 4 and 6 with an adhesive 50 such as an acrylic adhesive. A pressure sensitive acrylic adhesive 50 may be used. In situations where moisture vapor sealing properties are desired, a sealant 50, such as polyisobutylene (PIB), may be disposed between body 20 and the ends of sidewalls 12. Adhesive 50 may provide a dual function by providing the adhesive strength and the sealing properties.

In some optional configurations, a moisture vapor barrier, such as a metal foil, may be wrapped around head 22 and body 24 to prevent moisture vapor from penetrating spacer 8 from outside of glass block 2.

Glass block 2 also may be sealed by (1) placing a bead of sealant into the notches defined between head 22, body 20, and sidewalls 12. This is useful when a moisture vapor barrier foil is used. Glass block 2 also may be sealed by (2) covering the exposed portions of spacer 8 with a sealant—such as a PIB, a hot melt butyl, or a reactive hot melt sealant—as shown, for example, in FIG. 3 by reference numeral 60. Sealant 60 covers the seams where halves 4 and 6 engage spacer 8. A drawback with this method is that bead 60 is visible through the inner surface of sidewalls 12 when viewed along sight lines 62 (see FIG. 3 for reference). Bead 60 forms an undesirable incongruity to the appearance of sidewall 12. In order to eliminate this incongruity, sealant bead 60 may be stretched to cover the entire outer surface of sidewalls 12—from lip 70 to lip 70—as shown in FIG. 2. Such a bead 60 may be extruded with a wide die 72. Another manner of sealing spacer 8 is (3) to wrap spacer 8 with an adhesive tape 80 that sticks to glass and is impervious to moisture vapor. Tape 80 may include an inner sealant layer 82 (such as a PIB or a butyl) with an outer body layer (that may be waterproof). A waterproof outer body layer may be necessary when a water-based mortar will be used to connect adjacent glass blocks 2. Tape 80 may be as wide as lips 70 to provide a uniform appearance to glass block 2. Another method of providing a uniform appearance is to seal spacer 8 with a sealant bead 60 and then paint the outer surface of sidewalls 12 with a paint that matches the color of sealant bead 60.

Glass block 2 may be assembled by first wrapping spacer 8 around the outer perimeter of liter 10 wherein spacer 8 is held in place by adhesive 30 disposed in slot 25, by fingers 32, or by friction. The wrapped lite is then connected to one of the glass block halves 4 or 6 by adhesively connecting one side of body 20 to the end of wall 12. The adhesive may be carried by the outer surface of body 20. The corner defined between one leg 24 and body 20 helps align spacer 8 in the correct position all the way around glass block half 4 or 6 when the wrapped lite is initially positioned. The other glass block half 4 or 6 is then pressed down onto the other side of spacer body 20 and adhesively secured. The unit is then hermetically sealed by one of the methods described above such as by extruding a sealant over the exposed outer surface of spacer 8.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration of the invention is an example and the invention is not limited to the exact details shown or described. Throughout the description and claims of this specification the word "comprise" and variations of that word, such as "comprises" and "comprising," are not intended to exclude additives, components, integers, or steps.

The invention claimed is:

1. A glass block assembly; comprising:

first and second glass block portions; each glass block portion having a sidewall and an outer face; the sidewalls having inner surfaces and outer surfaces; the glass block portions facing each other to define an internal chamber;

a spacer disposed between the glass block portions to thermally isolate the first glass block portion from the second glass block portion;

the spacer including a body disposed directly between the sidewalls of the glass block portions;

a sealant extending between the spacer and the glass block to hermetically seal the internal chamber;

the spacer having a pair of legs extending laterally outwardly from the body to define shoulders that engage the inner surfaces of the first and second glass block portions;

the legs of the spacer defining a slot; and an interior lite disposed in the interior chamber; the interior lite being carried by the spacer.

2. The assembly of claim 1, wherein the sidewalls of the first and second glass block portions are adhesively connected to the body of the spacer.

3. The assembly of claim 1, further comprising an adhesive disposed in the slot to secure the lite in the slot.

4. The assembly of claim 1, wherein the interior lite is low-e coated.

5. The assembly of claim 1, wherein the entire slot is defined by the legs of the spacer with no portion of the slot of the spacer disposed directly between the sidewalls of the first and second glass block portions.

6. The assembly of claim 1, wherein the spacer includes a head that projects outwardly from the outer surfaces of the first and second glass block portions.

7. The assembly of claim 1, wherein a portion of the slot is defined by the body of the spacer and is directly disposed between the sidewalls of the first and second portions.

8. The assembly of claim 1, further comprising fingers extending from the spacer into the slot.

9. The assembly of claim 8, wherein the fingers are angled toward an end of the slot.

10. The assembly of claim 1, further comprising arms that extend outwardly from the legs of the spacer; the arms being positioned along the inner surfaces of the first and second glass block portions.

11. The assembly of claim 1, wherein each of the first and second glass block portions includes a lip projecting outwardly at the corner defined by the sidewall and the front face; the sealant extending from the lip of the first glass block portion to the lip of the second glass block portion.

12. The assembly of claim 1, wherein the sealant is in the form of an adhesive tape having an inner sealant layer and an outer body layer.

13. The assembly of claim 12, wherein the outer body layer is waterproof.

14. The assembly of claim 1, wherein the outer surfaces of the first and second glass block portions are painted.

15. The assembly of claim 1, wherein the spacer is flexible.

16. The assembly of claim 15, wherein the spacer carries a desiccant.

17. The assembly of claim 15, wherein the spacer is silicone.

18. A glass block assembly; comprising:

first and second glass block portions; each glass block member having a sidewall and an outer face; the sidewalls having inner surfaces and outer surfaces; the glass block portions facing each other to define an internal chamber;

a spacer disposed between the glass block portions to thermally isolate the first glass block member from the second glass block member;

the spacer including a body disposed directly between the sidewalls of the glass block portions;

a sealant extending between the spacer and the glass block to hermetically seal the internal chamber;

the spacer having a pair of legs extending laterally outwardly from the body to define shoulders that engage the inner surfaces of the first and second glass block portions; and an interior lite disposed in the interior chamber; the interior lite being carried by the spacer and engaging at least one of the legs of the spacer.

19. The assembly of claim 18, wherein the spacer includes a pair of arms that extend along the inner surfaces of the sidewalls of the glass block portions.

20. The assembly of claim 18, wherein the sidewalls of the first and second glass block portions are adhesively connected to the body of the spacer.

21. The assembly of claim 18, wherein a slot is defined by the legs of the spacer with no portion of the slot of the spacer disposed directly between the sidewalls of the first and second glass block portions.

22. The assembly of claim 18, wherein the spacer includes a head that projects outwardly from the outer surfaces of the first and second glass block portions.

* * * * *